US007057128B1

(12) United States Patent
Oyagi et al.

(10) Patent No.: US 7,057,128 B1
(45) Date of Patent: Jun. 6, 2006

(54) PUSH-ON SWITCH

(75) Inventors: Shingo Oyagi, Okayama (JP); Yasunori Yanai, Okayama (JP); Yoshikazu Yagi, Okayama (JP); Hisashi Watanabe, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/287,277

(22) Filed: Nov. 28, 2005

(30) Foreign Application Priority Data

Jan. 18, 2005 (JP) ..... 2005-009844

(51) Int. Cl.
*H01H 5/18* (2006.01)

(52) U.S. Cl. ..... 200/406; 200/516

(58) Field of Classification Search .... 200/16 R–16 D, 200/512, 516, 517, 406, 520, 292
See application file for complete search history.

(56) References Cited

U.S. PATENT DOCUMENTS 5,898,147 A * 4/1999 Domzalski et al. ..... 200/406
6,271,487 B1 * 8/2001 Domzalski et al. ..... 200/406
6,498,312 B1 * 12/2002 Villain ..... 200/406
6,610,950 B1 * 8/2003 Kamio et al. ..... 200/406
6,646,217 B1 * 11/2003 Omata ..... 200/406
6,670,566 B1 * 12/2003 Wang ..... 200/406
6,747,218 B1 * 6/2004 Huseman et al. ..... 200/406
6,894,240 B1 * 5/2005 Komoto et al. ..... 200/406

FOREIGN PATENT DOCUMENTS

JP 2004-119115 4/2004

* cited by examiner

*Primary Examiner*—Michael A. Friedhofer
(74) *Attorney, Agent, or Firm*—Wenderoth, Lind & Ponack, L.L.P.

(57) ABSTRACT

A first stationary contact (i.e., center stationary contact) has a center contact point exposed at the center on the bottom of a recess in a square-shaped switch base as viewed from the above. The first stationary contact is disposed to the bottom of the recess with its lead paths extended along one of diagonal lines of the square-shaped switch base from the center contact point toward both side edges of the switch base. Second stationary contacts (i.e., outer stationary contacts) are arranged at positions along an outer brim of the recess in a line-symmetrical manner about the one of the diagonal lines in areas opposite each other along the other diagonal line. The first stationary contact and the second stationary contacts are arranged in this manner and secured into embedment by means of insertion molding in the bottom of the recess in the switch base of an insulation resin.

4 Claims, 3 Drawing Sheets

PUSH-ON SWITCH

FIELD OF THE INVENTION

The present invention relates to push-on switches to be mounted and used in control units of electronic devices such as digital still cameras (DSC), portable phones, and the like.

BACKGROUND OF THE INVENTION

With the advancement of electronic devices toward downsizing and low-profiling in recent years, there is a strong demand for reduction in size and thickness of push-on switches for use in the electronic devices while also providing superior electrical and mechanical characteristics. Description is provided of one such push-on switch of the prior art with reference to FIG. 4 and FIG. 5.

FIG. 4 is a cross sectional view of a conventional push-on switch, and FIG. 5 is a plan view of a switch base of the push-on switch shown in FIG. 4. Here, FIG. 4 illustrates a structure in which a complete assembly of the push-on switch is sectioned along the line 4—4 shown in FIG. 5.

In FIG. 4 and FIG. 5, switch base 301 made of an insulation resin is generally square in the exterior configuration as viewed from the above, and formed into a box-like shape with open-top recess 311 provided in the upper surface.

There are center stationary contact 302 and outer stationary contacts 303, all made of plated metals, and secured to the bottom of recess 311 by insertion molding.

Center stationary contact 302 has center contact point 323, which is exposed in the center of recess 311. Outer stationary contacts 303 have respective outer contact points 333 exposed in two positions along the outer brim of recess 311 with a predetermined distance of insulation spaces from center stationary contact 302.

Lead paths 321 and 331 branched out respectively from center contact point 323 and outer contact points 333 extend toward side edges of switch base 301 in an embedded form in the bottom of switch base 301, and the individual portions protruding outside from the side edges serve as terminals 322 and 332 for external connections.

Movable contact 304 is formed of a thin sheet metal into an upwardly convexed dome-like shape. This movable contact 304 is disposed in a manner that lower peripheral rim 341 thereof rests on outer contact points 333 of outer stationary contacts 303. Movable contact 304 is thus housed inside recess 311 in a manner that lower surface 342 at the dome-like top portion of movable contact 304 confronts the center contact point 323 of center stationary contact 302 with a predetermined space.

Recess 311 of switch base 301 is then covered with seal plate 305 made of a heat resistant plastic film such as polyimide, which is secured with adhesive to the upper surface of switch base 301.

Referring now to the plan view of the switch base in FIG. 5, description is provided in further detail of the arrangement of center stationary contact 302 and outer stationary contacts 303.

Recess 311 in switch base 301 is formed into generally a circular shape, as viewed from the above, in an area substantially the center of its square configuration. A single trace of lead path 321 is embedded and extends diagonally in one direction from center contact point 323 of center stationary contacts 302 set to be exposed at the center position on an inner bottom surface of recess 311. Lead path 321 protrudes outward from a side edge of switch base 301, and forms terminal 322.

Lead paths 331 extend individually from outer contact points 333 of the two outer stationary contacts 303 disposed along the other diagonal direction. The individual lead paths 331 extend and protrude outward from the side edges of switch base 301, and they individually form terminals 332.

The conventional push-on switch constructed as above operates in a manner which is described hereinafter. First of all, when a center portion of seal plate 305 is pushed from the upper side, a center portion of the dome-like movable contact 304 bends downward. If the pushing force on this dome-like center portion exceeds a predetermined amount, movable contact 304 is deformed into an inversed shape with a tactile response, and lower surface 342 of the top center portion comes in contact with center contact point 323 of center stationary contact 302. This completes a continuity between outer stationary contacts 303 and center stationary contact 302 through movable contact 304, thereby establishing an electrical turn-on mode.

When the pushing force impressed on the center portion of seal plate 305 is removed thereafter, movable contact 304 regains the original shape having the dome-like center portion in the upwardly convexed configuration with another tactile response by its resilient restoring force, thereby resuming the original state of electrical turn-off mode in which lower surface 342 of the dome-like top center portion comes apart from center stationary contact 302, as shown in FIG. 4.

The prior art documents known to be relevant to the present invention include Japanese Patent Unexamined Publication, No. 2004-119115, for example.

In the conventional push-on switch as described above, however, lead path 321 extends only to one side along the diagonal direction of switch base 301 from center contact point 323 of center stationary contact 302 disposed to the center of recess 311 in switch base 301, and lead paths 331 of two outer stationary contacts 303 are arranged at respective positions along the other diagonal direction, as shown in FIG. 5. For this reason, switch base 301 is subject to an adverse influence of heat when being connected with solder to a wiring board of an end use product. As a consequence, switch base 301 is likely to bear variations in expansion and shrinkage throughout areas where insert members such as lead paths 321 and 331 are embedded and corner areas where lead paths 321 and 331 are not present.

SUMMARY OF THE INVENTION

A push-on switch of the present invention has a structure comprising:

(a) a switch base made of an insulation resin into a box-like shape with a square configuration as viewed from the above and a recess formed therein, the switch base provided with a first stationary contact connected with a first terminal protruding outside and a second stationary contact connected with a second terminal also protruding outside, both stationary contacts secured to the bottom of the recess by insertion molding;

(b) a movable contact disposed in the recess, for making and breaking an electrical continuity between the first stationary contact and the second stationary contact responsive to a pushing manipulation; and (c) a covering member for covering the recess.

The first stationary contact is so arranged that a center contact point of it is exposed in a center position of the switch base, and provided with first lead paths extending along one of the diagonal lines of the switch base from the center contact point toward both side edges of the switch base.

The second stationary contact is arranged at a position along an outer brim of the recess in respective areas divided by the first lead paths of the first stationary contact in a line-symmetrical manner about the above diagonal line.

In other words, the first stationary contact (i.e., center stationary contact) has the center contact point exposed on the bottom surface in the center of the recess in the switch base. The first lead paths, which extend along the one of the diagonal lines of the switch base from the center contact point toward respective side edges, are disposed in the bottom of the recess in the switch base. The second stationary contact (i.e., outer stationary contact) is arranged respectively in a position diagonal to each other along the outer brim of the recess in the line-symmetrical manner about the above-noted one of the diagonal lines. The first stationary contact and the second stationary contact are disposed in this manner on the bottom of the recess in the switch base made of the insulation resin, and secured into embedment by insertion molding.

With this structure, the push-on switch of the present invention can reduce a possibility of deformation of the switch base due to heat applied to it when being soldered, for instance, thereby providing the push-on switch with a stable performance.

DETAILED DESCRIPTION OF PREFERRED EMBODIMENTS

A push-on switch of the present invention comprises at least the following components, i.e., a switch base, a movable contact and a covering member.

The switch base is formed of an insulation resin into a box-like shape with a square configuration as viewed from the above, and it has a recess formed therein. The switch base is provided with a first stationary contact connected with a first terminal protruding outside and second stationary contacts connected with second terminals also protruding outside, both contacts secured to the bottom of the recess by insertion molding The movable contact is disposed inside the recess of the switch base, and adapted to make and break an electrical continuity between the first stationary contact and the second stationary contacts responsive to a pushing manipulation. The covering member closes the recess in the switch base.

The first stationary contact is so arranged that a center contact point of it is exposed in a center position of the switch base. First lead paths are provided in a manner to extend along one of the diagonal lines of the switch base from the center contact point toward both side edges.

The second stationary contacts are arranged at positions along the outer brim of the recess of the switch base in areas divided by the first lead paths of the first stationary contact in a line-symmetrical manner about the above one of the diagonal lines.

In addition to the first lead paths, the first stationary contact may optionally be provided with second lead paths extending in their respective directions along the other one of the diagonal lines of the switch base from the center contact point.

First Embodiment

Figure 1:
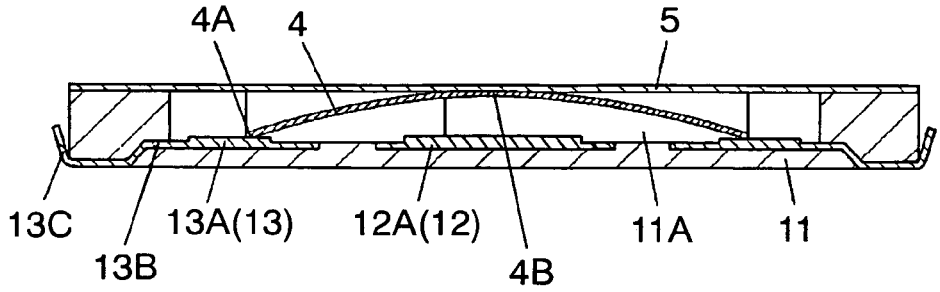
FIG. 1 is a cross sectional view of a push-on switch according to a first exemplary embodiment of the present invention.
Figure 2:
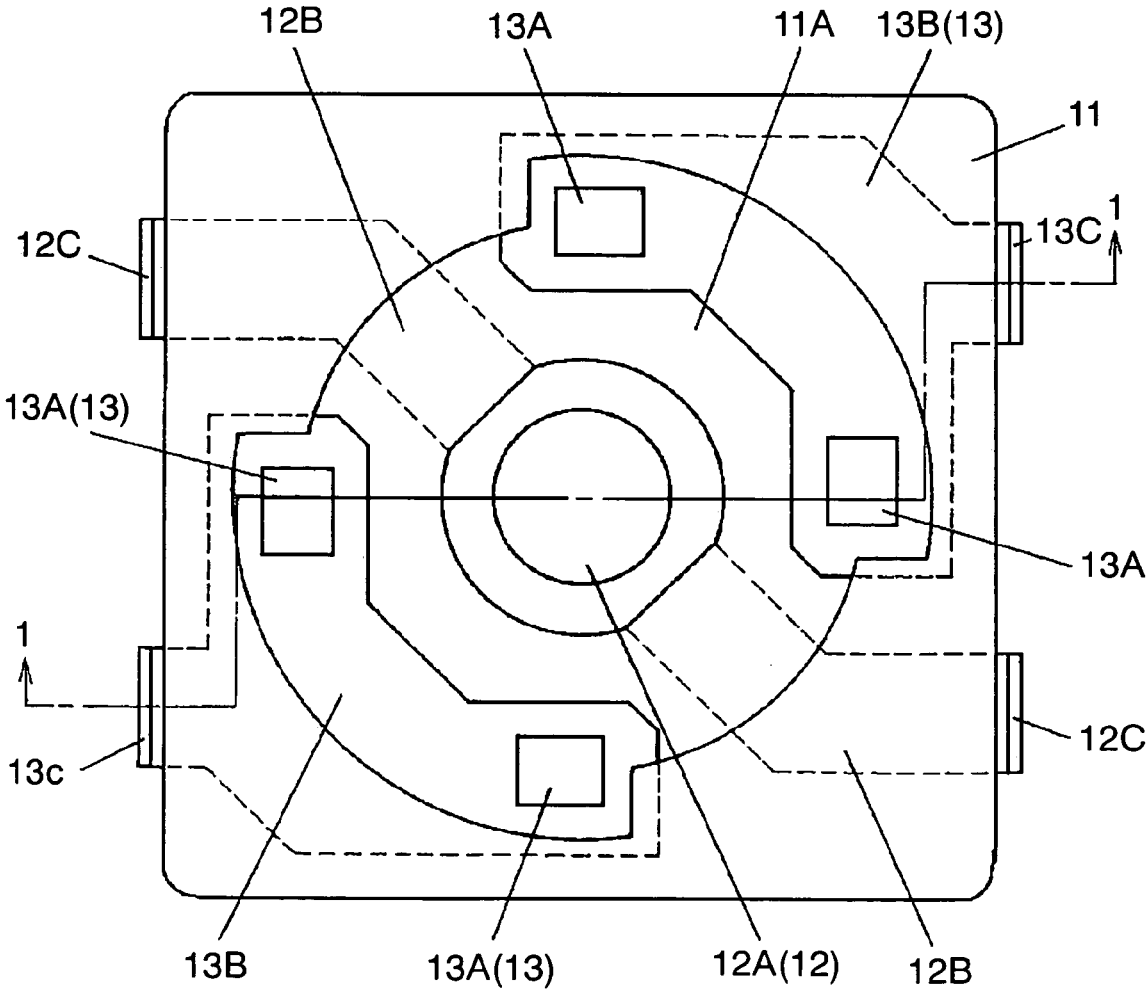
FIG. 2 is a plan view of a switch base of the push-on switch shown in FIG. 1.

Referring now to FIG. 1 and FIG. 2, description is provided more concretely of a structure of the first embodiment according to the present invention.

FIG. 1 is a cross sectional view of a push-on switch according to the first embodiment of this invention, and FIG. 2 is a plan view of a switch base of the push-on switch shown in FIG. 1. The cross sectional view of FIG. 1 depicts the structure in which a complete assembly is sectioned along the line 1—1 shown in FIG. 2.

In switch base 11 made of an insulation resin shown in FIG. 1, center stationary contact 12 representing a first stationary contact is secured to a bottom surface in the center of open-top recess 11A, and outer stationary contacts 13 representing second stationary contacts are secured to the bottom surface at positions along an outer brim of recess 11A and confronting each other across center stationary contact 12, all by means of insertion molding.

Center contact point 12A of center stationary contact 12 is exposed on the bottom surface in the center of recess 11A of switch base 11. Likewise, outer contact points 13A of outer stationary contacts 13 are exposed in the areas along the outer brim of recess 11A.

Furthermore, there is an upwardly convexed dome-like movable contact 4 having a circular configuration so disposed that lower peripheral rim 4A rests on outer contact points 13A. Lower surface 4B at the top portion of movable contact 4 confronts center contact point 12A with a predetermined space. Seal plate 5 serving a covering member is secured to the upper surface of recess 11A of switch base 11.

One of the features of the push-on switch according to this invention is a condition of embedding and securing center stationary contact 12 and outer stationary contacts 13, that is, an arrangement configuration of the components inserted to switch base 11.

In this arrangement configuration, center contact point 12A of center stationary contact 12 (i.e., the first stationary contact) is exposed in a circularly raised form in the center position on the inner bottom surface of recess 11A in switch base 11, as shown in FIG. 2. In addition, there are first lead paths 12B arranged in a manner to extend from center contact point 12A to respective directions along one of the diagonal lines connecting between the upper left corner and the lower right corner of switch base 11 shown in FIG. 2. These first lead paths 12B are embedded and secured to the bottom of recess 11A in switch base 11 by insertion molding. The individual first lead paths 12B extending in both directions from center contact point 12A toward the upper left corner and the lower right corner protrude outward from the side edges of switch base 11, and they are connected to their corresponding first terminals 12C.

Outer stationary contacts 13 (i.e., the second stationary contacts) are disposed to respective positions of switch base 11 along the outer brim of recess 11A in areas divided by first lead paths 12B of center stationary contact 12 in a line-symmetrical manner about the one of the diagonal lines, and secured by means of insertion molding so that outer contact points 13A are raised upward. Outer lead paths 13B extending individually from outer contact points 13A protrude outward at respective sides of switch base 11, and they are connected to second terminals 13C.

Outer lead paths 13B of the individual outer stationary contacts 13 formed in the shape of generally the letter L are embedded and secured to switch base 11 along the outer brim of recess 11A. The L-shaped contacts 13 are provided with outer contact points 13A raised upward at each of their end portions. In other words, outer contact points 13A are arranged at two locations in each of the areas at the upper right and the lower left of recess 11A. Moreover, outer contact points 13A at four locations altogether are disposed at nearly equal angles around a circumference corresponding to the outer configuration of movable contact 4.

As described, the push-on switch of this exemplary embodiment is so contrived that center stationary contact 12 and outer stationary contacts 13, or the insert members, are arranged in their optimum positional relation, and secured to the inside of switch base 11 with no imbalance when viewed from the above, without requiring use of any new component.

This structure can reduce a possibility of deformation and the like failures of switch base 11 due to changes in temperature when being soldered for mounting to a wiring board of an end use product, thereby realizing outstanding performances in the operating response and stability of contact.

Since the push-on switch of the present invention has outer contact points 13A of outer stationary contacts 13 arranged at four locations of equally divided angles around center contact point 12A of center stationary contact 12, these outer contact points 13A can bear a pushing force evenly when applied through movable contact 4 during a pushing manipulation of the push-on switch, so as to improve a tactile response produced by deformation of the dome-like component into the inversed shape. The plurality of contact areas between lower peripheral rim 4A of movable contact 4 and outer contact points 13A can also improve reliability of the electrical contact.

Second Embodiment

Figure 3:
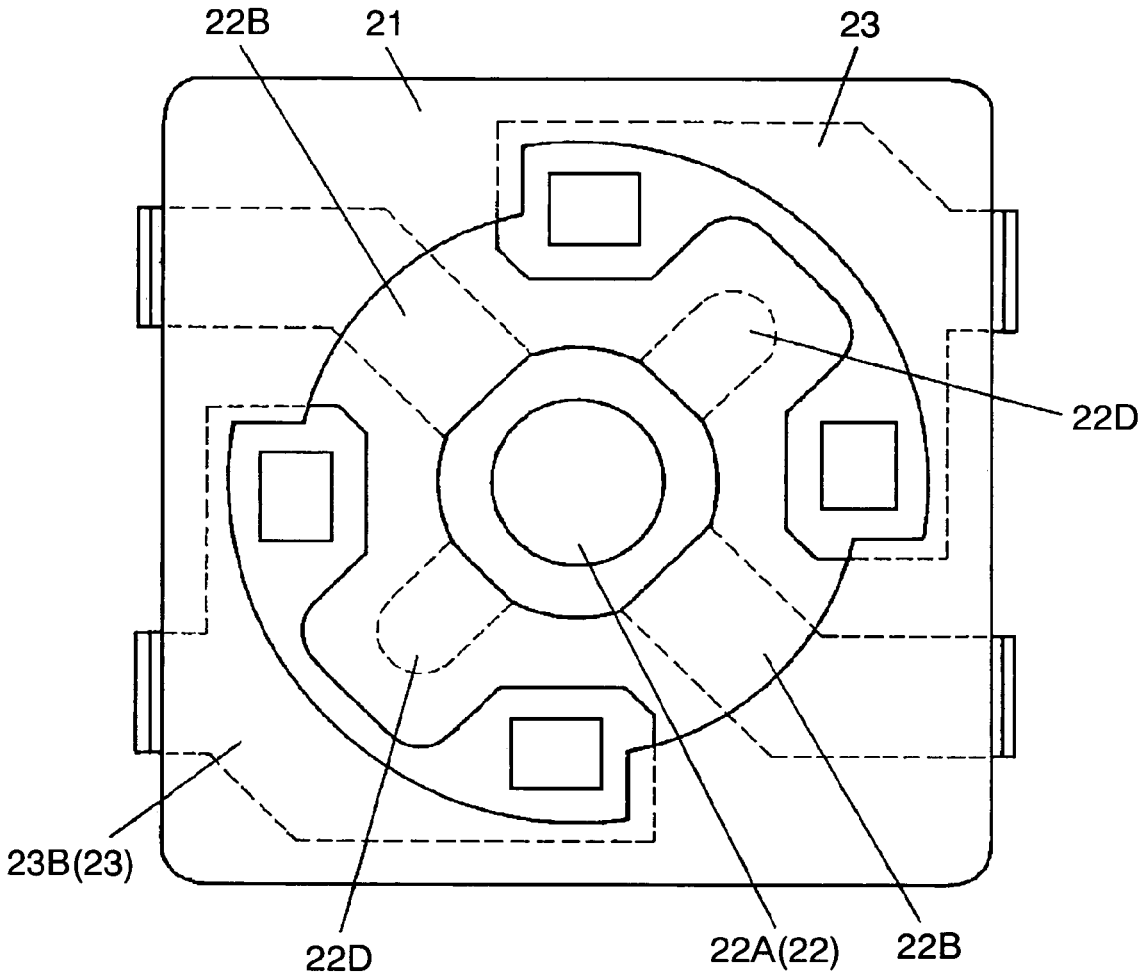
FIG. 3 is a plan view of a switch base according to a second exemplary embodiment of the present invention.
Figure 4:
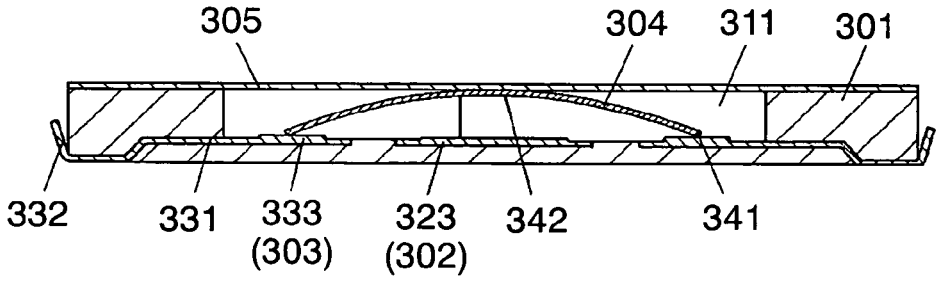
FIG. 4 PRIOR ART
FIG. 4 is a cross sectional view of a conventional push-on switch.
Figure 5:
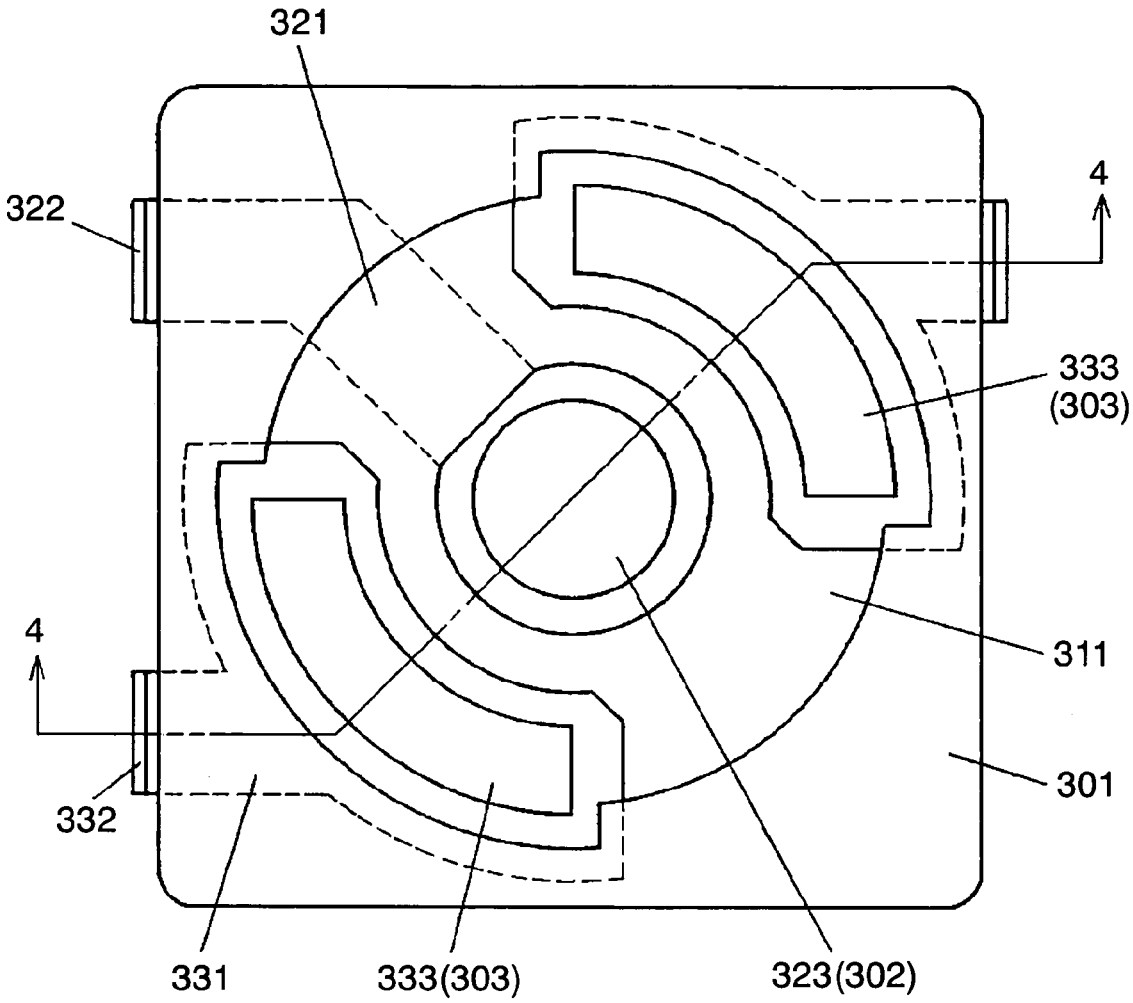
FIG. 5 PRIOR ART
FIG. 5 is a plan view of a switch base of the push-on switch shown in FIG. 4.

FIG. 3 is a plan view of a switch base according to the second exemplary embodiment of the present invention. Description will be provided of a push-on switch of this embodiment shown in FIG. 3 with the priority given to different parts from those of the first exemplary embodiment shown in FIG. 1 and FIG. 2.

That is, switch base 21 illustrated in FIG. 3 is provided, in addition to what are shown in the first exemplary embodiment of FIG. 2, with second lead paths 22D secured into embedment to a recess in switch base 21 in a manner to extend in directions along a diagonal line toward respective areas where outer stationary contacts 23 defining the second stationary contacts are secured from center contact point 22A of center stationary contact 22 defining the first stationary contact secured by means of insertion molding.

While the individual second lead paths 22D extend toward corner areas of L-shaped outer lead paths 23B, they are arranged with a predetermined distance of insulation spaces from outer stationary contacts 23.

It is desirable that fore-ends of second lead paths 22D are extended to positions inside of the L-shaped areas of outer lead paths 23B to make the insert members occupy the areas widely. Here, "fore-ends of second lead paths 22D are extended to positions inside the L-shaped areas" means that the fore-ends of second lead paths 22D are extended beyond phantom lines connecting two edges of the respective L-shapes of outer lead paths 23B toward the areas at the L-shaped corner sides.

As shown, center stationary contact 22 having center contact point 22A includes second lead paths 22D extending in the directions along one of the diagonal lines in addition to first lead paths 22B extending in the directions along the other of the diagonal lines, and secured into embedment in switch base 21 by the insertion molding. This embodiment can thus suppress thermal deformation of switch base 21 in both diagonal directions, and further reduce an extent of the deformation during solder mounting.

As described above, the push-on switch of the present invention is so constructed that the insert members are arranged without any imbalance on the switch base of generally square shape as viewed from the above. The invention thus has the advantageous feature of preventing the switch base from being deformed due to the heat during soldering, and providing outstanding operating response and stability of contact, thereby making the push-on switch useful for a control unit of any electronic device such as DSC, portable phone, and the like.

What is claimed is:

1. A push-on switch comprising:

(a) a switch base made of an insulation resin into a box-like shape with a square configuration as viewed from above and a recess formed therein, the switch base provided with a first stationary contact connected with a first terminal protruding outside and a second stationary contact connected with a second terminal protruding outside, both the stationary contacts secured to the bottom of the recess by insertion molding;

(b) a movable contact disposed in the recess, for making and breaking an electrical continuity between the first stationary contact and the second stationary contact responsive to a pushing manipulation; and (c) a covering member for covering the recess, wherein the first stationary contact has a center contact point arranged in a manner to be exposed in a center position of the switch base, and first lead paths extending along one of diagonal lines of the switch base from the center contact point toward both side edges of the switch base, and the second stationary contact is arranged at a position along an outer brim of the recess in respective areas divided by the first lead paths of the first stationary contact in a line-symmetrical manner about the one of the diagonal lines.

2. The push-on switch of claim 1, wherein the first stationary contact further comprises second lead paths in addition to the first lead paths, the second lead paths extending in their respective directions along the other one of the diagonal lines of the switch base from the center contact point.

3. The push-on switch of claim 2, wherein the second stationary contact has a L-shaped lead path, and each of the second lead paths extends in a direction of a corner area of the L-shaped outer lead path of the corresponding second stationary contact.

4. The push-on switch of claim 3, wherein a fore-end of each of the second lead paths is extended beyond a phantom line connecting two edges of the L-shaped outer lead path of the corresponding second stationary contact toward an area at the L-shaped corner sides.

* * * * *